US011586134B2

(12) United States Patent
Maeda

(10) Patent No.: US 11,586,134 B2
(45) Date of Patent: Feb. 21, 2023

(54) FIXING DEVICE PROVIDED WITH SLIDE SHEET FIXED BETWEEN SUPPORT PORTIONS AND IMAGE FORMING DEVICE INCLUDING FIXING DEVICE

(71) Applicant: SHARP KABUSHIKI KAISHA, Sakai (JP)

(72) Inventor: Tomohiro Maeda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/351,738

(22) Filed: Jun. 18, 2021

(65) Prior Publication Data

US 2022/0019164 A1 Jan. 20, 2022

(30) Foreign Application Priority Data

Jul. 15, 2020 (JP) ..... JP2020-121300

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
USPC ..... 399/328
See application file for complete search history.

(56) References Cited

U.S. PATENT DOCUMENTS

2004/0131401 A1* 7/2004 Nakatogawa ..... G03G 15/2053 399/328
2011/0116848 A1* 5/2011 Yamaguchi ..... G03G 15/2064 399/329
2014/0064804 A1 3/2014 Yamaguchi et al.
2016/0252855 A1* 9/2016 Ishida ..... G03G 15/2053 399/329

FOREIGN PATENT DOCUMENTS

EP 3671355 A1 * 6/2020 ..... G03G 15/2025
JP 2014-048487 A 3/2014

* cited by examiner

*Primary Examiner* — Quana Grainger
(74) *Attorney, Agent, or Firm* — ScienBiziP, P.C.

(57) ABSTRACT

A fixing device includes an endless fixing belt capable of rotational movement, a pressure roller that presses from the outside of the fixing belt, a nip forming member that is arranged on an inner circumference surface side of the fixing belt and forms a fixing nip region between the fixing belt and the pressure roller, a support member that supports the nip forming member from an opposite side to the fixing nip region, and a slide sheet provided between the fixing belt and the nip forming member. The support member includes two support portions. The slide sheet is fixed between the two support portions.

10 Claims, 19 Drawing Sheets

FIXING DEVICE PROVIDED WITH SLIDE SHEET FIXED BETWEEN SUPPORT PORTIONS AND IMAGE FORMING DEVICE INCLUDING FIXING DEVICE

FIELD OF THE INVENTION

The present invention relates to a fixing device and an image forming device including the fixing device such as a copying machine, a multifunction machine, a facsimile machine, and a printer.

As the fixing device, there has been known a fixing device which presses a pressure roller from the outside to the inside of an endless fixing belt capable of rotational movement, forms a fixing nip region between the fixing belt and the pressure roller by a nip forming member disposed on the inner circumference surface side of the fixing belt, supports the nip forming member by a support member from the side opposite to the fixing nip region, and provides a slide sheet between the fixing belt and the nip forming member (see, for example, Japanese Unexamined Patent Publication No. 2014-48487).

In the fixing device, the slide sheet is fixed to the support member at both the upstream side and the downstream side of the fixing nip region in the conveying direction of a recording medium such as recording paper. As a method of fixing the slide sheet to the support member, a fastening member such as a screw is used.

DESCRIPTION OF THE BACKGROUND ART

However, since the fixing method is required to use a plurality of fastening members on the upstream side and the downstream side, the number of members for fixing the slide sheet increases. Further, when the slide sheet is fixed by the fastening members on both the upstream side and the downstream side in the conveying direction of the recording medium, a space for fixing the slide sheet is required.

Therefore, it is an object of the present invention to provide a fixing device and an image forming device capable of reducing the number of members for fixing a slide sheet and realizing space saving for fixing the slide sheet.

SUMMARY OF THE INVENTION

In order to solve the above problem, a fixing device according to the present invention incudes an endless fixing belt capable of rotational movement, a pressure roller that presses from an outside of the fixing belt, a nip forming member that is arranged on an inner circumference surface side of the fixing belt and forms a fixing nip region between the fixing belt and the pressure roller, a support member that supports the nip forming member from an opposite side to the fixing nip region, and a slide sheet provided between the fixing belt and the nip forming member. The support member includes two support portions, and the slide sheet is fixed between the two support portions.

Further, an image forming device according to the present invention includes the fixing device according to the present invention.

According to the present invention, it is possible to reduce the number of members for fixing the slide sheet, and realize space saving for fixing the slide sheet.

DESCRIPTION OF THE PREFERRED EMBODIMENTS

Figure 1:
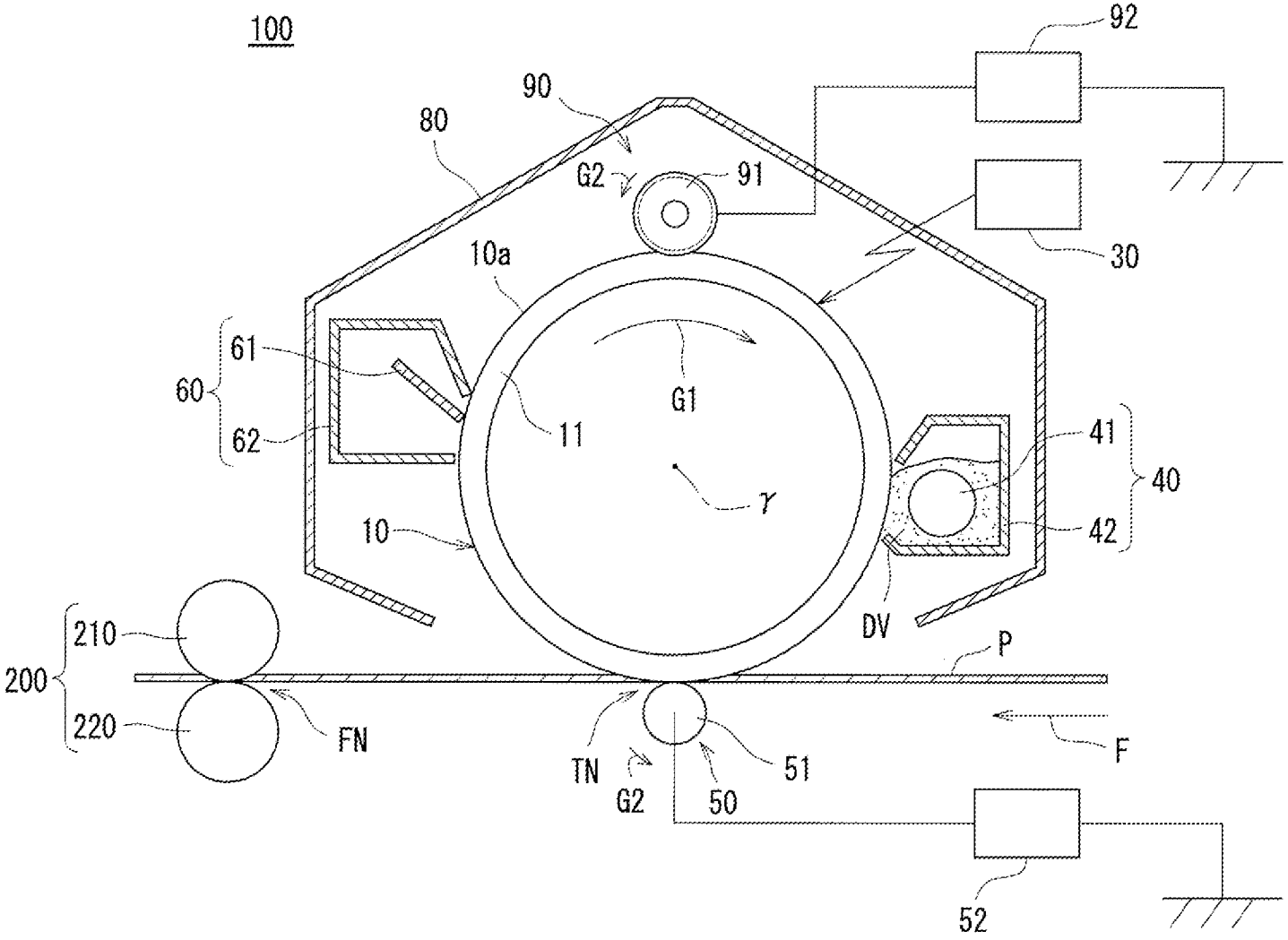
FIG. 1 is a cross-sectional view schematically showing an overview configuration of an image forming device including a fixing device according to an embodiment of the present invention.

Hereafter, embodiments according to the present invention will be described with reference to the drawings. In the following description, the same components are designated by the same reference numerals. Their names and functions are the same. Therefore, the detailed description thereof will not be repeated.

Image Forming Device

FIG. 1 is a cross-sectional view schematically showing a schematic configuration of an image forming device 100 including a fixing device 200 according to an embodiment of the present invention.

As shown in FIG. 1, the image forming device 100 includes a photosensitive drum 10 serving as an image carrier, a charging device 90, an exposure device 30, a developing device 40, a transfer device 50, a cleaning device 60, and the fixing device 200. The charging device 90 charges a surface 10*a* of the photosensitive drum 10. The exposure device 30 exposes the photosensitive drum 10 charged by the charging device 90 to form an electrostatic latent image. The developing device 40 develops the electrostatic latent image formed by the exposure device 30 to form a toner image. The transfer device 50 transfers the toner image formed by the developing device 40 onto a recording medium P such as recording paper. The cleaning device 60 removes and recovers the toner remaining on the photosensitive drum 10. The fixing device 200 fixes the toner image transferred by the transfer device 50 onto the recording medium P conveyed in the conveying direction F to form an image. In this example, the image forming device 100 is a monochrome printer (specifically, a laser printer). Note that the image forming device 100 may be, for example, an intermediate transfer type color image forming device capable of forming a color image. Also, although the image forming device 100 is a printer in this example, it may be, for example, a copying machine, a multifunction machine, or a facsimile machine.

In the photosensitive drum 10, a base 11 is rotatably supported by a main frame (not shown) of the image forming device 100, and is rotationally driven in a predetermined first rotation direction G1 (clockwise in the drawing) around a rotation axis y by a driver which is omitted in the drawing.

The charging device 90 includes a charging member 91. The charging member 91 evenly charges the surface 10*a* of the photosensitive drum 10 to a uniform predetermined potential by a high voltage applying device 92. The charging member 91 is a charging roller in this example, and is driven to rotate in a second rotation direction G2 with respect to the rotation of the photosensitive drum 10. Note that the charging member 91 may be a electrostatic charging charger.

The exposure device 30 repeatedly scans the surface 10*a* of the photosensitive drum 10, which is rotationally driven, with the light modulated based on image information in the direction of the rotation axis y of the photosensitive drum 10, which is the main scanning direction. The developing device 40 includes a developing roller 41 and a developing tank 42. The developing roller 41 supplies a developer DV to the surface 10*a* of the photosensitive drum 10. The developing tank 42 contains the developer DV. The transfer device 50 includes a transfer member 51. The transfer device 50 applies a predetermined high voltage to a transfer nip region TN formed between the photosensitive drum 10 and the transfer device 50 by a high voltage applying device 52. The transfer member 51 is a transfer roller in this example, and is driven to rotate in the second rotation direction G2 with respect to the rotation of the photosensitive drum 10. Note that the transfer member 51 may be a transfer charger.

The cleaning device 60 includes a cleaning blade 61 and a recovery casing 62. The cleaning blade 61 removes the toner remaining on the surface 10*a* of the photosensitive drum 10. The recovery casing 62 accommodates the toner removed by the cleaning blade 61. The fixing device 200 includes a heat fixer 210 (heat fixing unit) and a pressure roller 220. The pressure roller 220 forms a fixing nip region FN together with the heat fixer 210. The detailed configuration of the fixing device 200 will be described below. Further, the image forming device 100 includes a housing 80 for accommodating each component constituting the image forming device 100.

Fixing Device

Figure 2A:
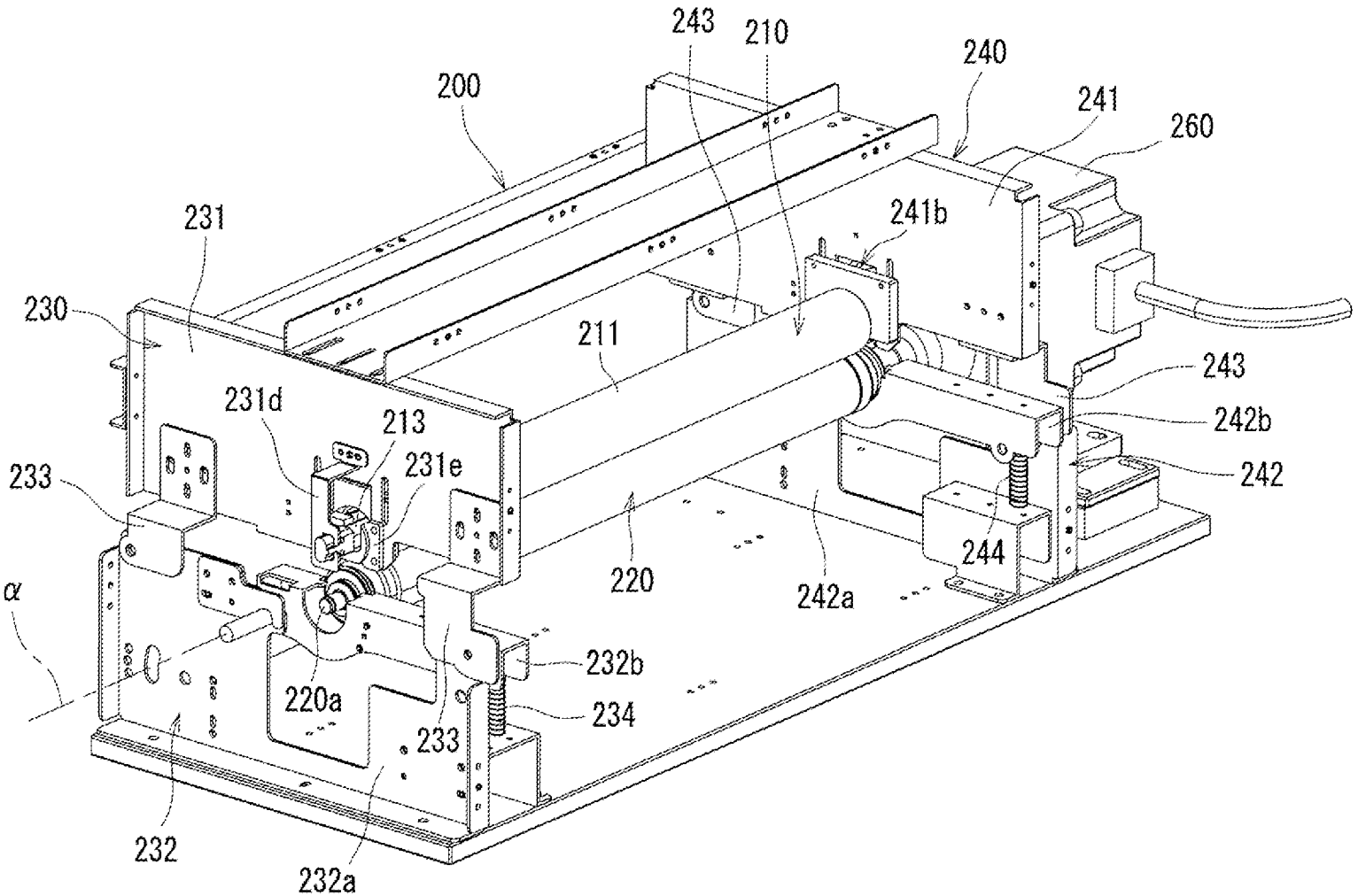
FIG. 2A is a perspective view of the fixing device in the image forming device shown in FIG. 1 as viewed from diagonally above the front side.
Figure 2B:
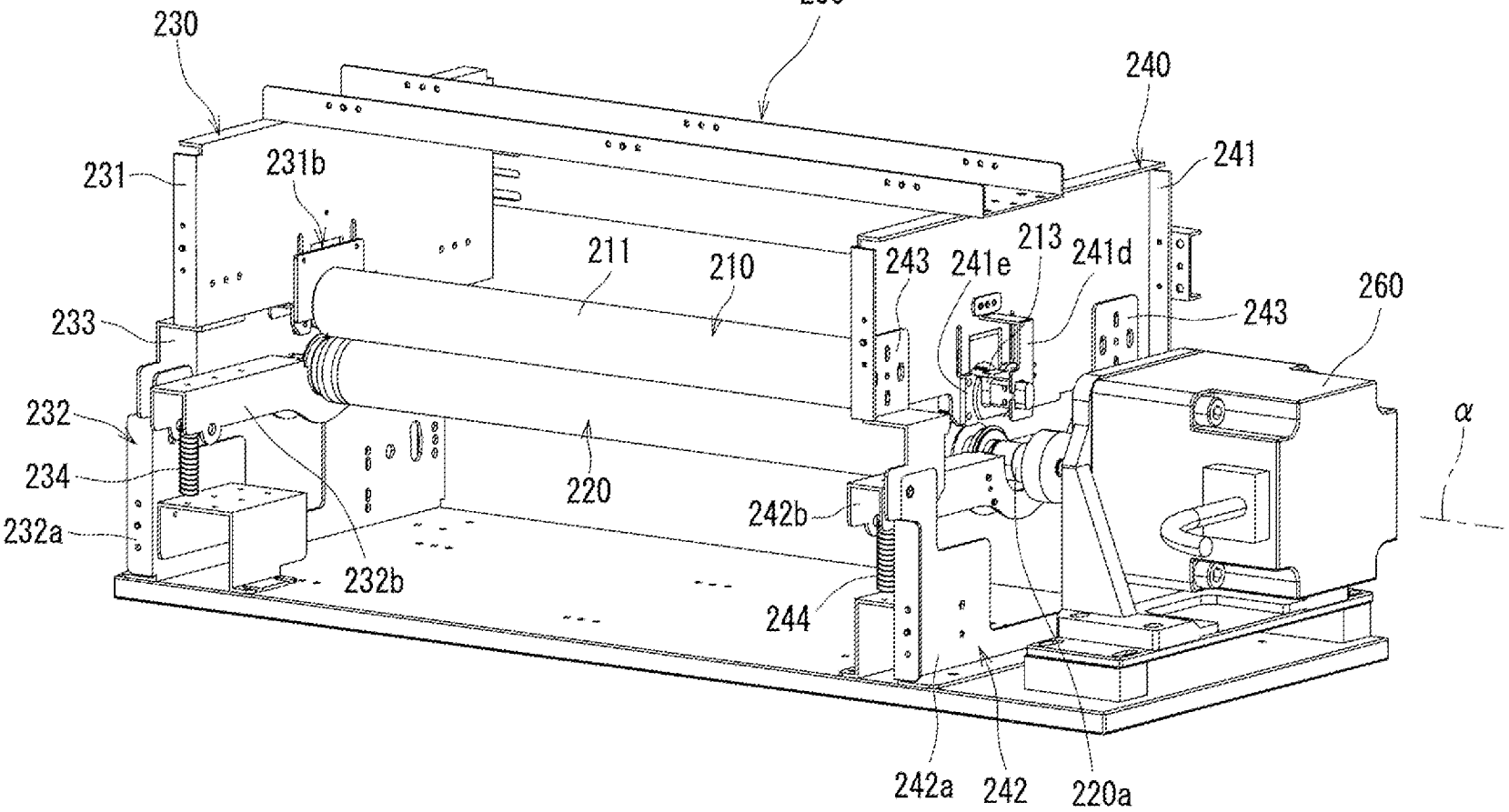
FIG. 2B is a perspective view of the fixing device in the image forming device shown in FIG. 1 as viewed from diagonally above the rear side.
Figure 3:
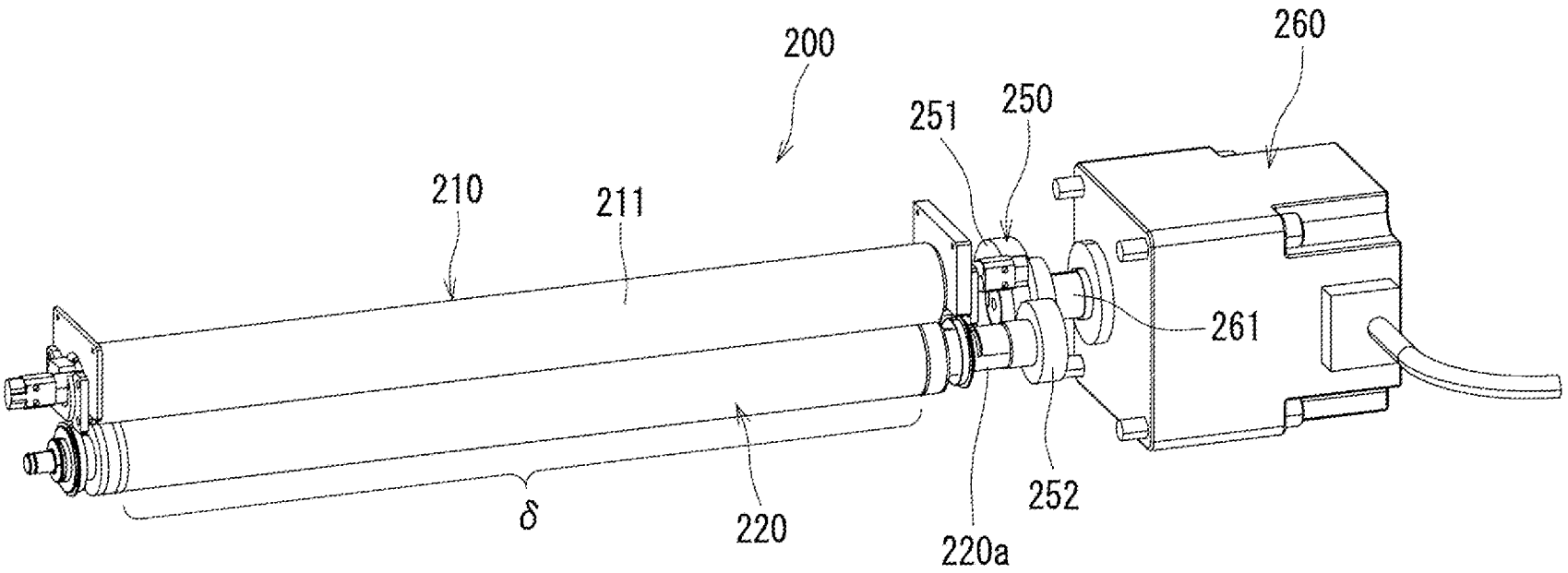
FIG. 3 is a perspective view showing a drive system to a pressure roller in the fixing device shown in FIGS. 2A and 2B as viewed from above on the right side.
Figure 4A:
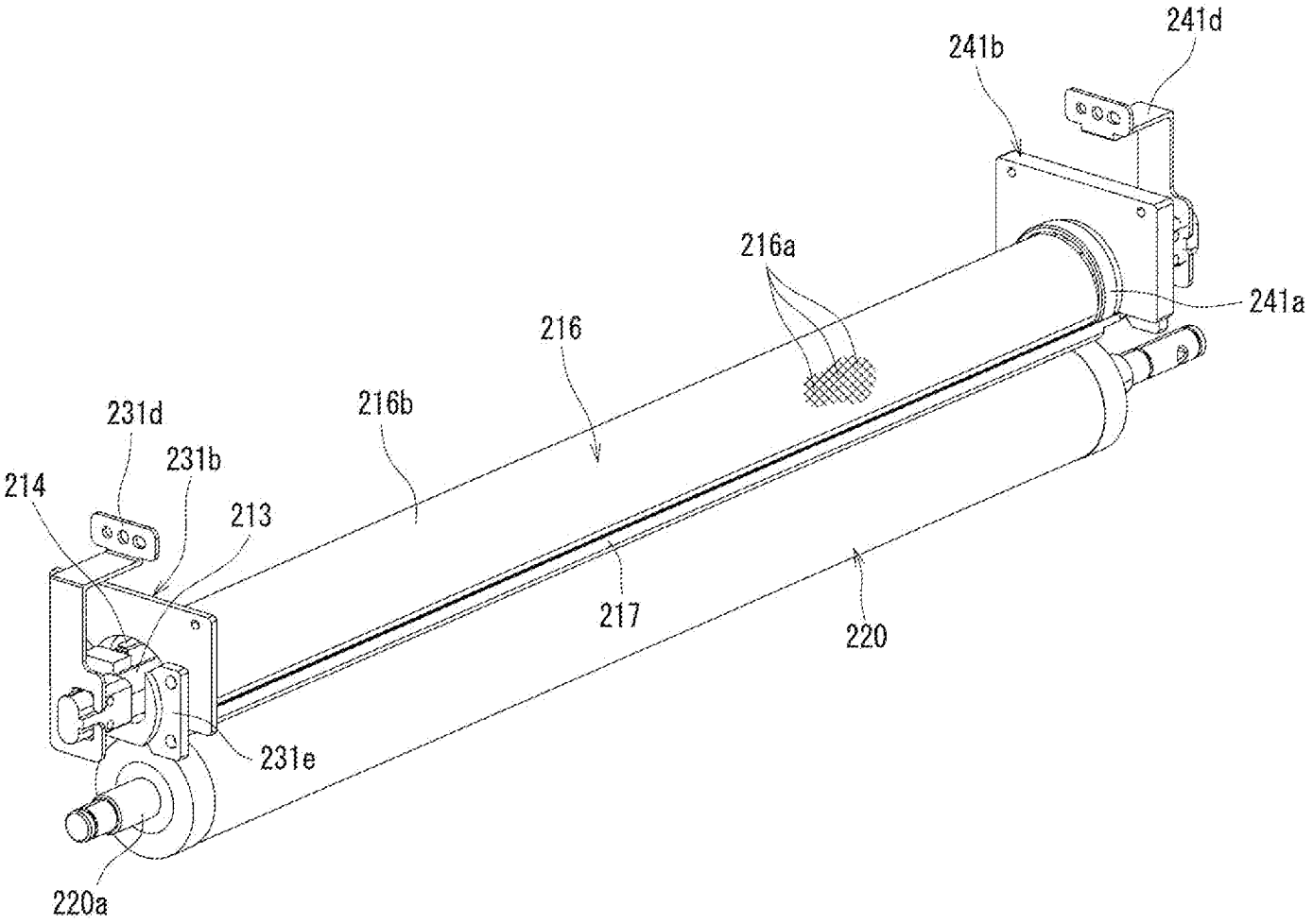
FIG. 4A is a perspective view of a portion of a heat fixer and a pressure roller in a state where a fixing belt is removed in the fixing device shown in FIGS. 2A and 2B, as viewed from diagonally above the front side.
Figure 4B:
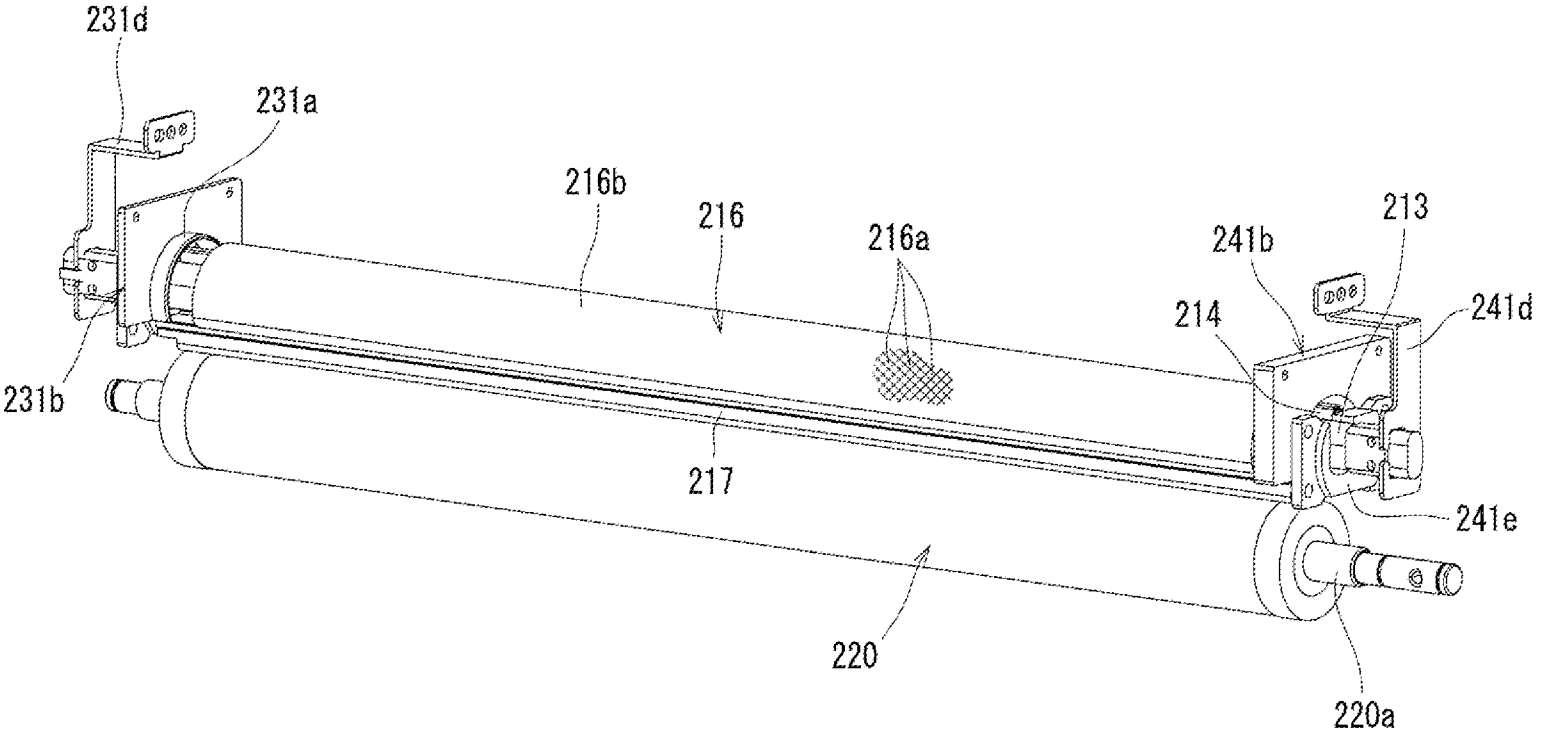
FIG. 4B is a perspective view of a portion of the heat fixer and the pressure roller in a state in which the fixing belt is removed in the fixing device shown in FIGS. 2A and 2B, as viewed from diagonally above the rear side.
Figure 5:
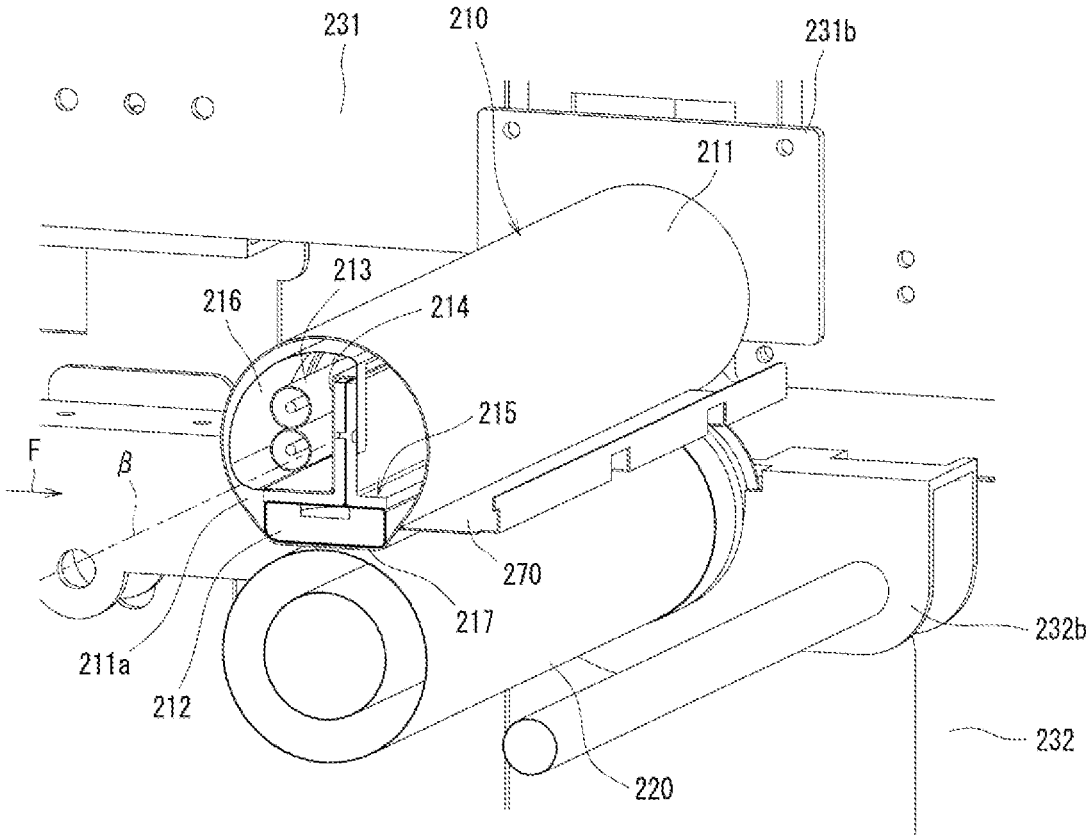
FIG. 5 is a perspective view showing a cross-sectional structure of a portion of the heat fixer and the pressure roller in the fixing device as viewed from the rear side.
Figure 6:
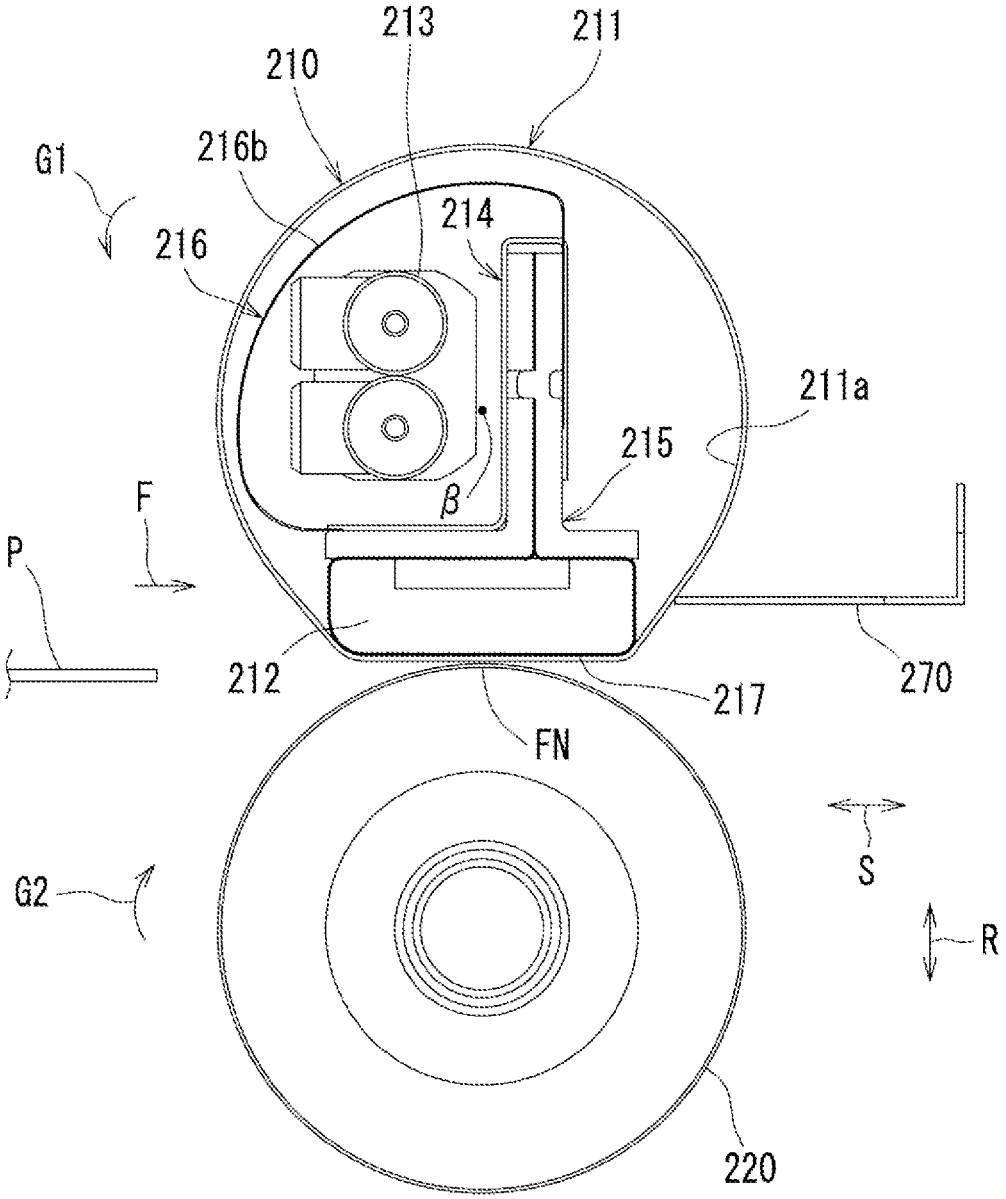
FIG. 6 is a cross-sectional view of a portion of the heat fixer and the pressure roller in the fixing device as viewed from the rear side.

FIGS. 2A and 2B are perspective views of the fixing device 200 in the image forming device 100 shown in FIG. 1, as viewed from diagonally above the front side and diagonally above the rear side, respectively. FIG. 3 is a perspective view showing a drive system to the pressure roller 220 in the fixing device 200 shown in FIGS. 2A and 2B as viewed from above on the right side. FIGS. 4A and 4B are perspective views of a portion of the heat fixer 210 and the pressure roller 220 in a state in which a fixing belt 211 is removed in the fixing device 200 shown in FIGS. 2A and 2B, as viewed from diagonally above the front side and diagonally above the rear side, respectively. FIG. 5 is a perspective view showing a cross-sectional structure of a portion of the heat fixer 210 and the pressure roller 220 in the fixing device 200 as viewed from the rear side. Further, FIG. 6 is a cross-sectional view of a portion of the heat fixer 210 and the pressure roller 220 in the fixing device 200 as viewed from the rear side.

As shown in FIGS. 2A and 2B, the fixing device 200 includes the heat fixer 210, a pressure roller 220, a front frame 230 (side plate), a rear frame 240 (side plate), and a peeling member 270. The front frame 230 includes a front upper frame 231, a front lower frame 232, and connecting portions 233. The front upper frame 231 and the front lower frame 232 are vertically connected by the connecting portions 233. The rear frame 240 includes a rear upper frame 241, a rear lower frame 242, and connecting portions 243. The rear upper frame 241 and the rear lower frame 242 are vertically connected by the connecting portions 243.

The heat fixer 210 includes the fixing belt 211, a nip forming member 212, a heater 213, a reflection member 214, a support member 215, a protection member 216, and a slide sheet 217.

The fixing belt 211 is an endless (tubular) heat-resistant belt (film) capable of rotational movement. The pressure roller 220 presses from the outside of the fixing belt 211. The nip forming member 212 is disposed on an inner circumference surface 211*a* side of the fixing belt 211 to form the fixing nip region FN between the fixing belt 211 and the pressure roller 220. The heater 213 heats the fixing belt 211 from the inside. The reflection member 214 reflects the light (particularly infrared light) emitted from the heater 213 toward the fixing belt 211. The support member 215 supports the nip forming member 212 from the side opposite to the fixing nip region FN. The slide sheet 217 is provided between the fixing belt 211 and the nip forming member 212.

The front upper frame 231 and the rear upper frame 241 support the front end portion and the rear end portion of the fixing belt 211, respectively, so that the fixing belt 211 be capable of rotational movement. The front upper frame 231 and the rear upper frame 241 are respectively provided with a front support member 231*b* having a half-ring-shaped sliding contact portion 231*a* and a rear support member 241*b* having a half-ring-shaped sliding contact portion 241*a*. The sliding contact portions 231*a* and 241*a* are provided so that the corresponding sliding contact surface faces the opposite side of the fixing nip region FN. The inside of both ends of the fixing belt 211 is slidably supported by the outside of the sliding contact portions 231*a* and 241*a* in the rotational axis 6 (see FIGS. 5 and 6). Thus, the fixing belt 211 is capable of rotational movement while the inner circumference surface 211*a* is in sliding contact with the sliding contact surface of the sliding contact portions 231*a* and 241*a*.

The fixing belt 211 may be a member in which a silicone rubber layer having a predetermined thickness (for example, about 100 μm to about 300 μm) is formed on a metal or polyimide (PI) substrate having a predetermined thickness (for example, about 30 μm to about 100 μm), and a fluororesin having a thickness (for example, about 20 μm to about 30 μm) is further formed on the silicone rubber layer, as an example. More specifically, the fixing belt 211 may be a member in which a PFA tube is provided or a fluororesin is coated on the silicone rubber layer.

The nip forming member 212 may be a member formed of a heat-resistant material having rigidity, such as liquid crystal polymer (LCP) resin and polyetheretherketone (PEEK) resin, or polyphenylene sulfide (PPS), as an example. In the case where the rigid nip forming member 212 is made to have elasticity, an elastic layer (for example, a rubber layer such as silicone rubber) can be provided on the surface thereof. In this example, the nip forming member 212 is made of a liquid crystal polymer having a thickness of 4.5 mm and a width of 15 mm in the short side direction S orthogonal to the axial direction M.

The slide sheet 217 may be a member (for example, a glass cloth sheet) obtained by applying a fluororesin such as polytetrafluoroethylene (PTFE) to a glass fiber material (for example, a glass cloth), as an example. The thickness of the slide sheet 217 is not limited thereto, but a sheet having a thickness of about 0.1 mm to 0.5 mm can be used, for example. In this example, the thickness of the slide sheet 217 is 0.13 mm.

The heater 213 includes a heater lamp. As shown in FIGS. 2A and 2B, the front end portion and the rear end portion of the heater 213 are fixed to the front upper frame 231 and the rear upper frame 241 via a front lamp support portion 231*d* and a rear lamp support portion 241*d*, respectively. The heater 213 raises the temperature up to, for example, close to 800° C.

The reflection member 214 is a plate-like member in this example, and is provided at least along the surface of the support member 215 facing the heater 213. The reflection member 214 is formed of a metal material such as aluminum. The surface of the reflection member 214 is mirror-finished. Thus, the fixing belt 211 can be efficiently irradiated with the light emitted from the heater 213. The reflection member 214 is fixed to the support member 215. The reflection member 214 is a plate (reflection plate) bent along the support member 215 so as to face at least the heater 213.

The protection member 216 is provided between the heater 213 and the fixing belt 211. The protection member 216 is a heat-resistant member configured to allow the light emitted from the heater 213 and/or the light reflected from the reflection member 214 to be applied to the fixing belt 211. The protection member 216 is provided with a large number of through holes 216*a* to 216*a* (see FIGS. 4A and 4B).

The protection member 216 may be a member in which a fibrous material is knitted into a mesh shape, a member in which a belt-shaped material is subjected to hole opening processing (punch processing) for providing the large number of through holes 216*a* to 216*a*, or a member in which a belt-shaped material is subjected to etching processing for providing the large number of through holes 216*a* to 216*a*, for example. The fibrous material may, for example, be a metal material such as stainless steel (SUS) or aluminum. The belt-shaped material may, for example, be a metal material such as stainless steel (SUS) or nickel. The thickness of the protection member 216 is preferably small, preferably about 0.5 mm or less.

The protection member 216 is provided so that the surface 216*b* facing the fixing belt 211 faces the upstream side of the fixing nip region FN in the conveying direction F of the recording medium P.

As shown in FIGS. 2A and 2B, the front lower frame 232 and the rear lower frame 242 includes a front lower frame body 232*a* and a rear lower frame body 242*a*, and a front rotating member 232*b* and a rear rotating member 242*b*, respectively. The front rotating member 232*b* and the rear rotating member 242*b* are supported so as to be rotatable about the rotation axis a by a rotary shaft, which is not shown, with respect to the front lower frame body 232*a* and the rear lower frame body 242*a*, respectively. The front rotating member 232*b* and the rear rotating member 242*b* respectively rotatably support the front end portion and the rear end portion of the rotary shaft 220*a* of the pressure roller 220. The front rotating member 232*b* and the rear rotating member 242*b* are respectively urged toward the fixing belt 211 by urging members 234 and 244 (coil springs) so that the pressure roller 220 presses the fixing belt 211. Thus, the pressure roller 220 can press the fixing belt 211.

The pressure roller 220 may be a member in which an elastic member (sponge rubber such as silicone rubber or rubber such as solid rubber) having a predetermined thickness (about 6 mm, for example) and a hardness of about 35 to 40 degrees is provided on a metal base such as aluminum, and a fluororesin is formed on the elastic member, as an example. More specifically, the pressure roller 220 may be a member in which a PFA tube is provided on the elastic member. In this example, the fluororesin is provided in a passage region 6 (see FIG. 3) of the recording medium P in the pressure roller 220. That is, the rubber member is exposed in a region other than the passage region 6 of the pressure roller 220 (for example, about 10 mm in each end region). This makes it easy for the driving (rotating) force from the pressure roller 220 to be transmitted to both ends of the fixing belt 211 at both ends of the pressure roller 220. As a result, the rotation failure of the fixing belt 211 can be effectively prevented.

As shown in FIG. 3, the pressure roller 220 is rotationally driven by a rotational driving force from a rotary driver 260 (driving motor) via a drive transmission mechanism 250. The drive transmission mechanism 250 includes a drive gear 251 and a driven gear 252. The drive gear 251 is fixed to a rotary shaft 261 of the rotary driver 260. The driven gear 252 is fixed to the rotary shaft 220*a* of the pressure roller 220 in a state of being meshed with the drive gear 251. Thus, the rotary driver 260 can rotationally drive the pressure roller 220 in the second rotation direction G2 via the drive transmission mechanism 250. Note that a heater (heater lamp) may be provided inside the pressure roller 220.

The peeling member 270 is a peeling plate provided in the vicinity of the fixing belt 211 on the downstream side of the fixing nip region FN in the first rotation direction G1 of the fixing belt 211. This effectively prevents the recording medium P that has passed between the fixing belt 211 and the pressure roller 220 from being wound around the fixing belt 211.

Regarding Present Embodiments

First Embodiment

Figure 7A:
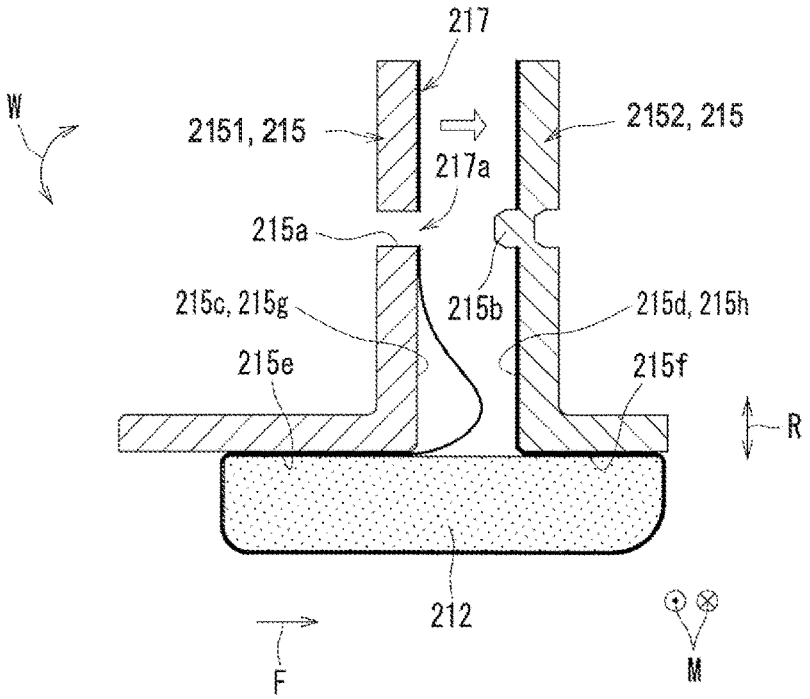
FIG. 7A is a cross-sectional view showing a state in which a slide sheet covers a nip forming member and is fixed to a support member in the fixing device according to the first embodiment.
Figure 7B:
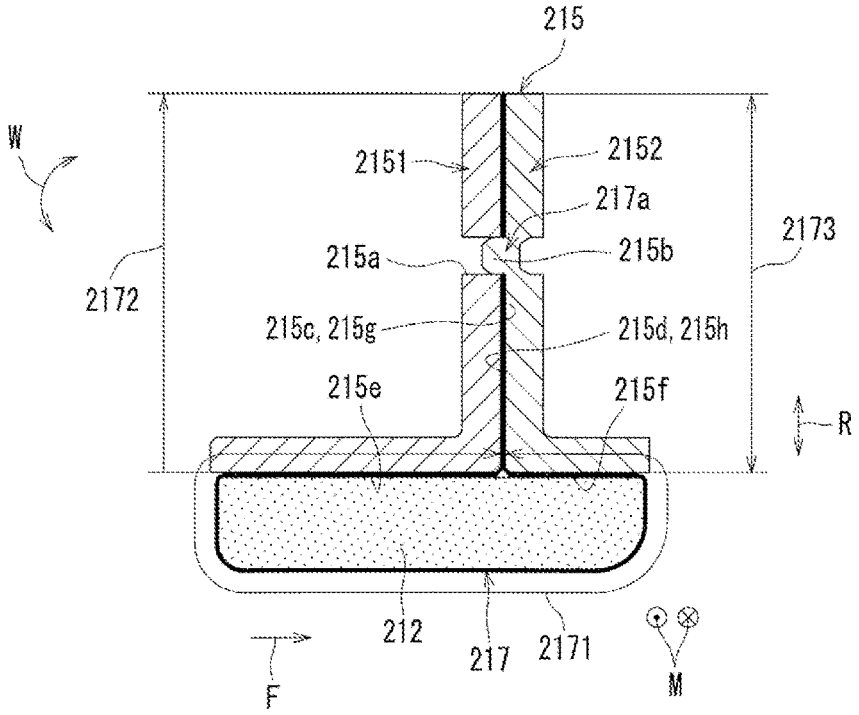
FIG. 7B is a cross-sectional view showing a state in which the slide sheet covering the nip forming member is fixed to the support member from the state shown in FIG. 7A.
Figure 8A:
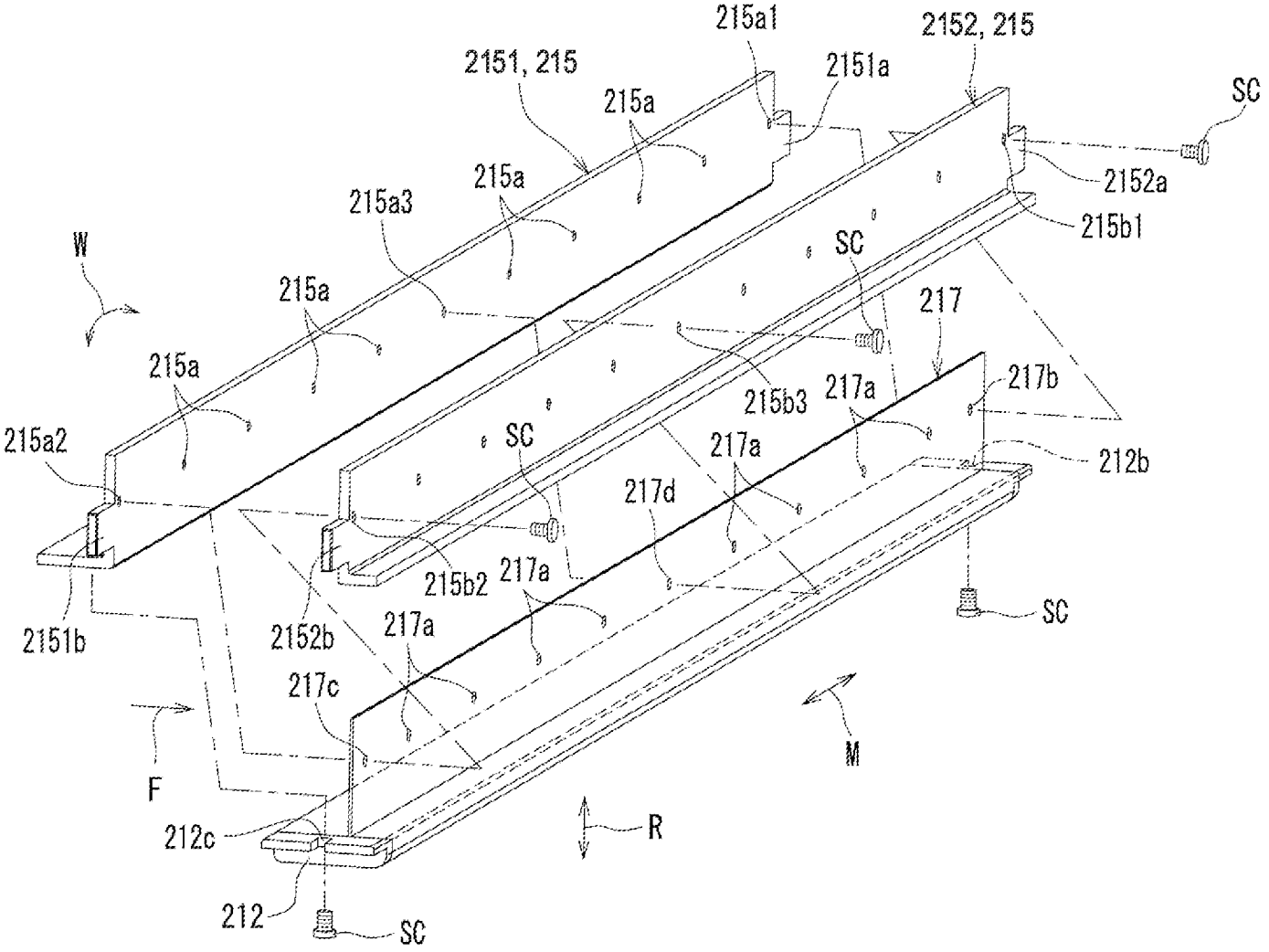
FIG. 8A is a perspective view of the nip forming member covering the slide sheet and two support portions of the support member in the fixing device according to the first embodiment as viewed from the upper right of the rear side.
Figure 8B:
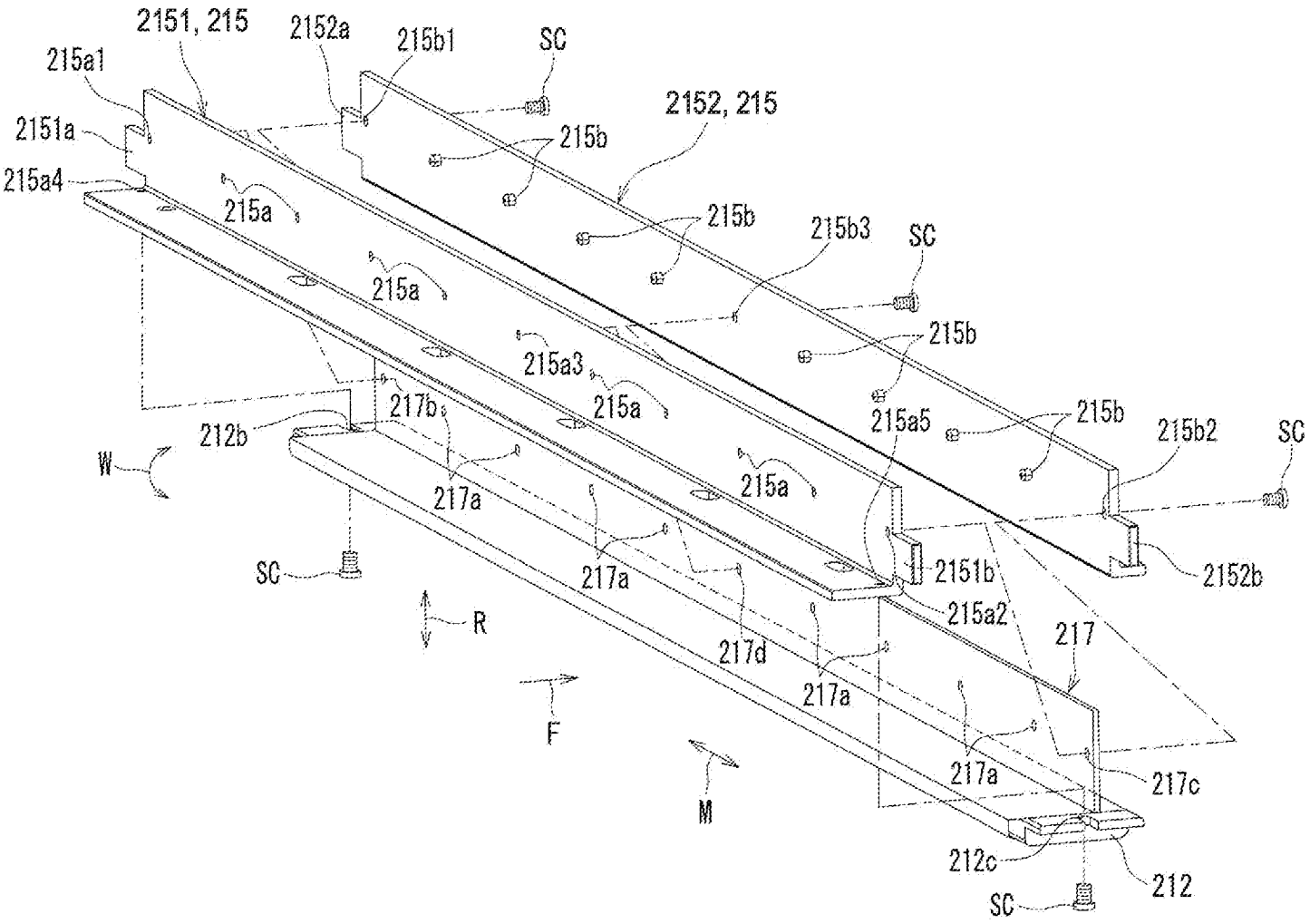
FIG. 8B is a perspective view of the nip forming member covering the slide sheet and the two support portions of the support member in the fixing device according to the first embodiment as viewed from the upper left of the rear side.
Figure 8C:
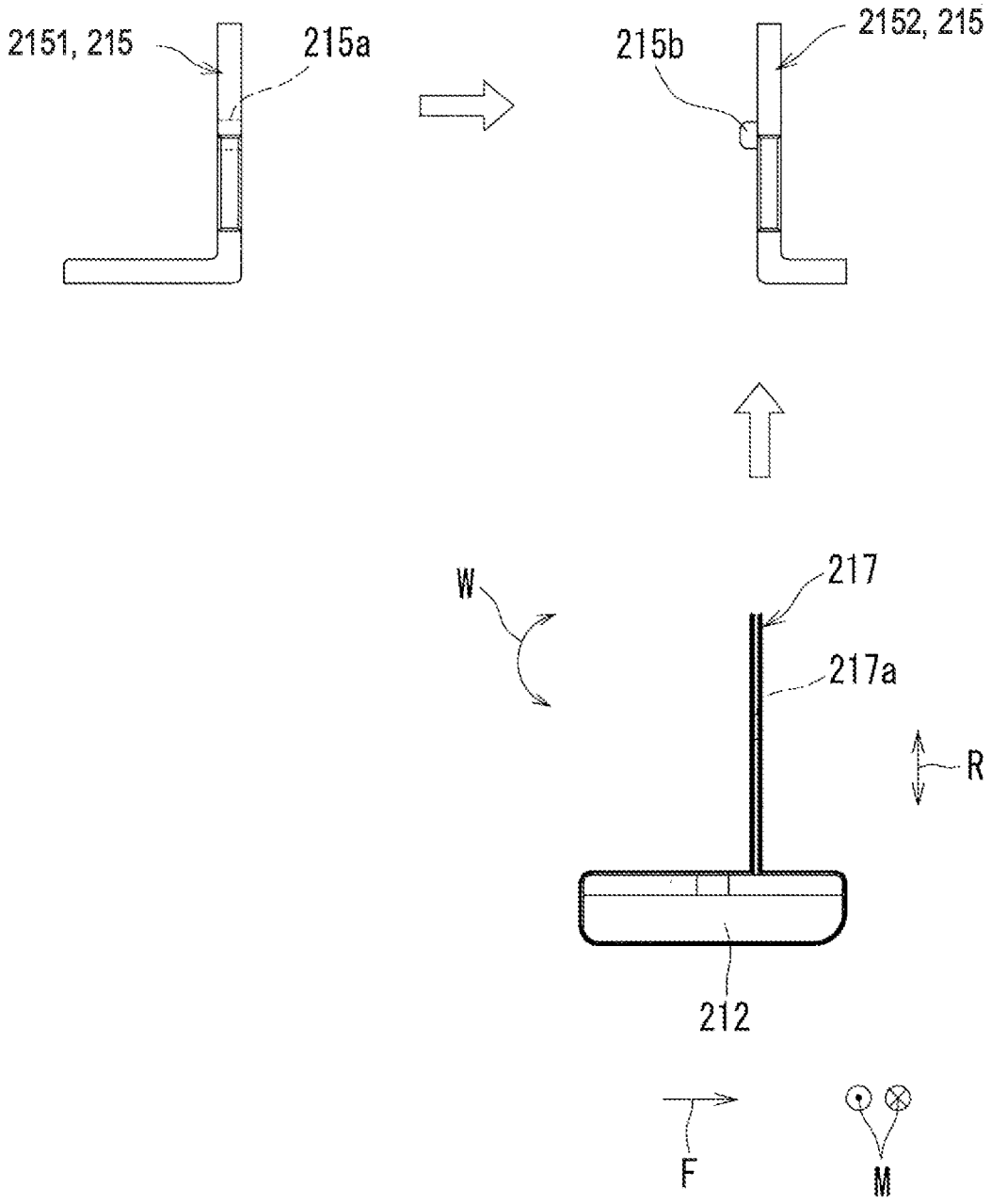
FIG. 8C is a front view of the nip forming member covering the slide sheet and the two support portions of the support member in the fixing device according to the first embodiment as viewed from the rear side.
Figure 9:
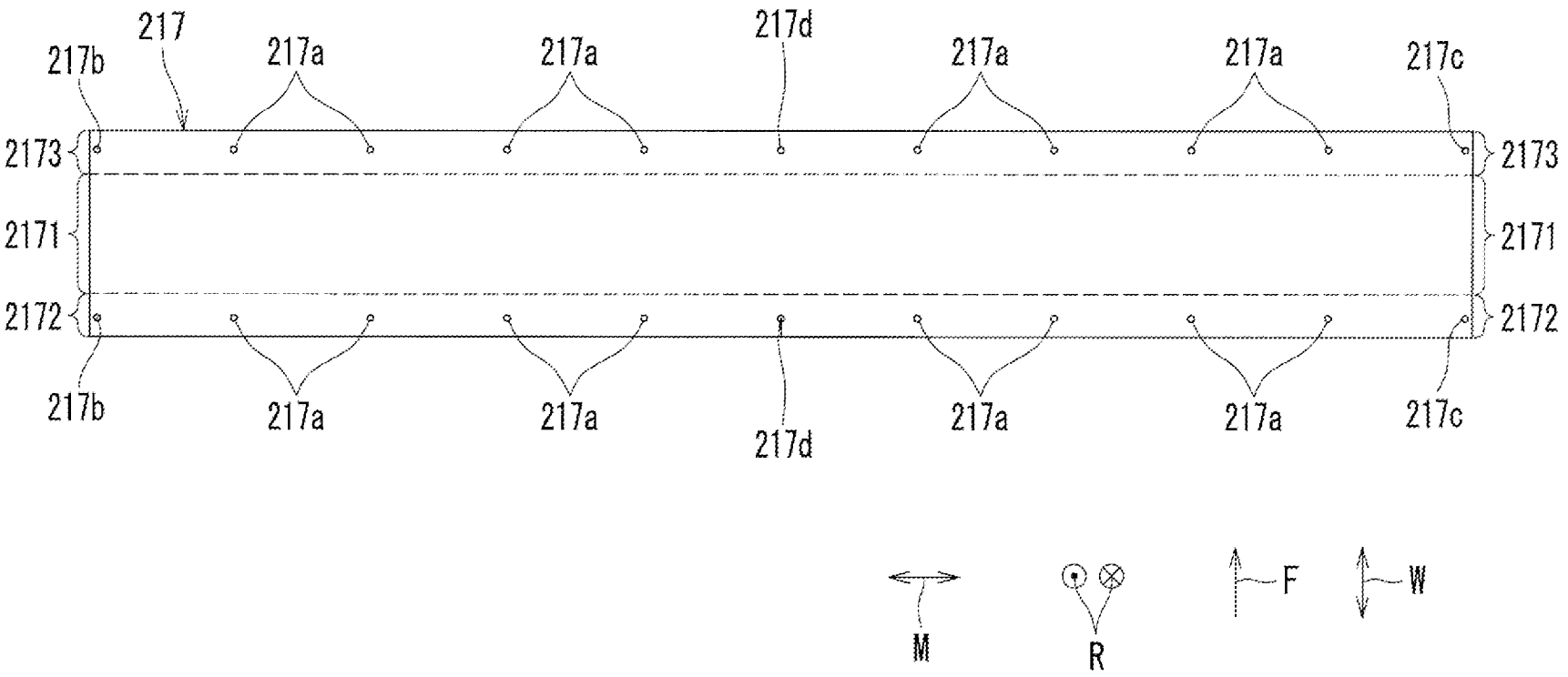
FIG. 9 is a developed view of the slide sheet in the fixing device according to the first embodiment.
Figure 10A:
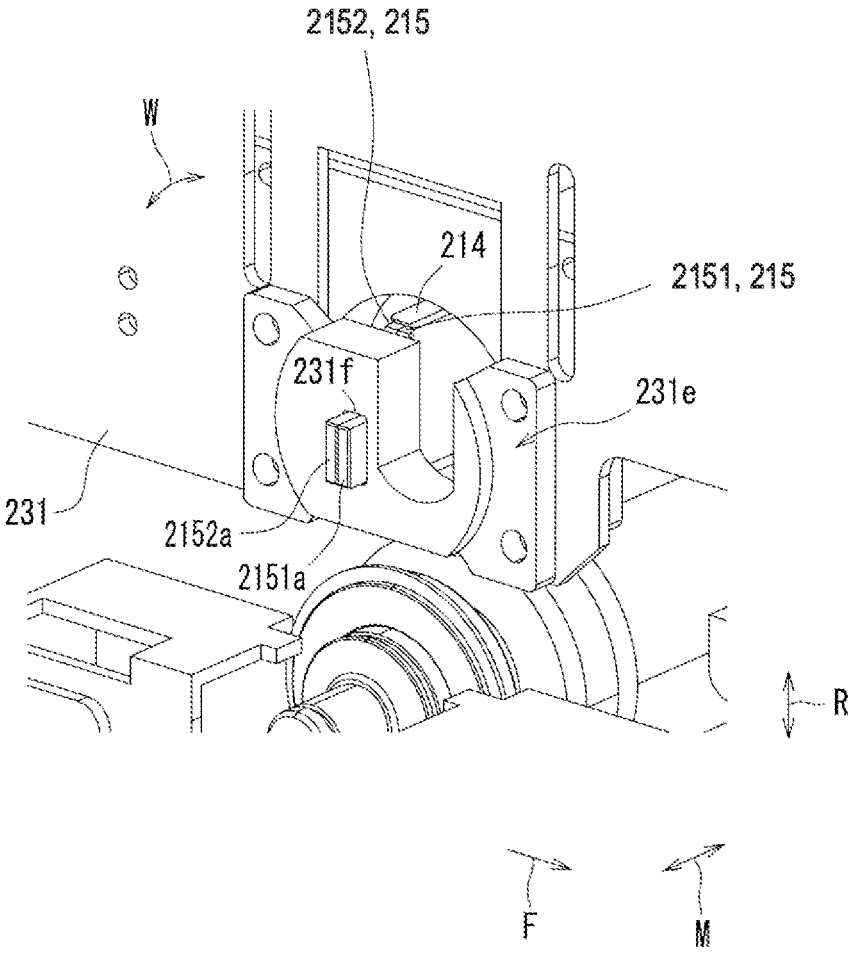
FIG. 10A is a perspective view showing a state in which a heater and a front lamp support portion are removed and the two support portions are attached to a front upper frame.
Figure 10B:
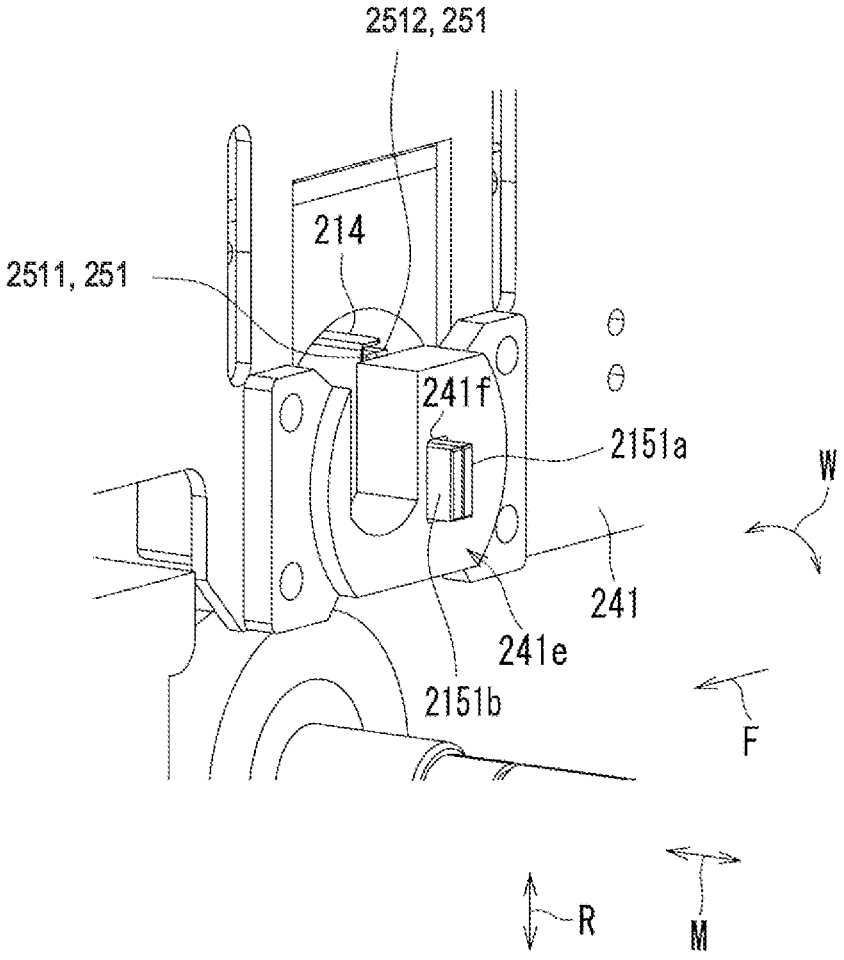
FIG. 10B is a perspective view showing a state in which the heater and a rear lamp support portion are removed and the two support portions are attached to a rear upper frame.

FIG. 7A is a cross-sectional view showing a state in which the slide sheet 217 covers the nip forming member 212 and is fixed to the support member 215 in the fixing device 200 according to the first embodiment. FIG. 7B is a cross-sectional view showing a state in which the slide sheet 217 covering the nip forming member 212 is fixed to the support member 215 from the state shown in FIG. 7A. FIGS. 8A to 8C are perspective views and a front view of the nip forming member 212 covering the slide sheet 217 and two support portions 2151 and 2152 of the support member 215 in the fixing device 200 according to the first embodiment as viewed from the upper right of the rear side, the upper left of the rear side, and the rear side, respectively. FIG. 9 is a developed view of the slide sheet 217 in the fixing device 200 according to the first embodiment. Further, FIGS. 10A and 10B are perspective views showing a state in which the heater 213, the front lamp support portion 231*d*, and the rear lamp support portion 241*d* are removed, and the two support portions 2151 and 2152 are attached to the front upper frame 231 and the rear upper frame 241, respectively.

In the present embodiment, the support member 215 includes the two support portions 2151 and 2152, and the slide sheet 217 is fixed between the two support portions 2151 and 2152.

According to the present embodiment, since the support member 215 includes the two support portions 2151 and 2152, and the slide sheet 217 is fixed between the two support portions 2151 and 2152, the slide sheet 217 can be fixed without using a fastening member such as a screw, whereby the number of members for fixing the slide sheet 217 can be reduced and the space for fixing the slide sheet 217 can be reduced. For example, in the case of the configuration as in the present embodiment, as shown in FIG. 6, a space on the upstream side in the conveying direction F of the recording medium P in the fixing belt 211 can be ensured, whereby the heater 213 can be provided in a space-saving manner.

In the present embodiment, the slide sheet 217 is fixed in a state of being sandwiched between the two support portions 2151 and 2152. Thus, the slide sheet 217 can be sandwiched between the two support portions 2151 and 2152, and thereby the slide sheet 217 can be reliably fixed between the two support portions 2151 and 2152.

In the present embodiment, a concave portion 215*a* is provided in the support portion 2151 which is one of the two support portions 2151 and 2152, and a convex portion 215*b* engaged with the concave portion 215*a* is provided in the other support portion 2152. The slide sheet 217 is fixed by the convex portion 215*b* engaged with the concave portion 215*a*. In this way, the movement of the slide sheet 217 can be reliably restricted in a state where the convex portion 215*b* is engaged with the concave portion 215*a*, whereby the slide sheet 217 can be stably fixed by the convex portion 215*b*. Further, since the concave portion 215*a* and the convex portion 215*b* are engaged with each other, the two support portions 2151 and 2152 can be reliably connected to each other, thereby improving the supportability to the nip forming member 212.

In the present embodiment, the concave portion 215*a* is a hole through which the convex portion 215*b* is inserted. Here, the hole may be a through hole or a bottomed hole. In this way, the hole (concave portion 215*a*) of the support portion 2151 and the convex portion 215*b* of the other support portion 2152 can be reliably engaged with each other, whereby the slide sheet 217 can be more stably fixed by the convex portion 215*b*.

The concave portion 215*a* in the support portion 2151 may be formed as a recess, for example, by half punch processing or a process of forming a through hole using a metal mold having a punch and a die, that is, so-called punch processing. In this example, the hole (concave portion 215*a*) is a through hole, and is formed by the punch processing. Further, the convex portion 215*b* of the other support portion 2152 can be formed, for example, by a process of forming a convex using a metal mold having a punch and a die, that is, so-called half punch processing.

In the present embodiment, the slide sheet 217 is provided with a hole 217*a* (through hole) through which the convex portion 215*b* is inserted. In this way, the hole 217*a* of the slide sheet 217 can be locked to the convex portion 215*b* of the other support portion 2152, whereby the movement of the slide sheet 217 can be more reliably restricted in a state where the hole 217*a* is locked to the convex portion 215*b*, and thus the slide sheet 217 can be reliably fixed.

The hole 217*a* in the slide sheet 217 can also be formed by, for example, punch processing in the same manner as the concave portion 215*a* in the other support portion 2152.

In the present embodiment, the slide sheet 217 is fixed at a plurality of points (eight points in this example) in the axial direction M which is the direction of the rotational axis 6 of the fixing belt 211, between the two support portions 2151 and 2152. Thus, the slide sheet 217 can be fixed in the axial direction M, whereby the slide sheet 217 can be reliably fixed between the two support portions 2151 and 2152 in the axial direction M.

More specifically, the concave portion 215*a* of the support portion 2151 and the convex portion 215*b* of the other support portion 2152 are provided at a plurality of points (eight points in this example) in the axial direction M.

Fastening portions 215*a*1, 215*a*2 and 215*a*3 (female screw holes in this example) each for fastening a fastening member SC such as a screw are provided at both of the end portions and the center portion of the support portion 2151 in the axial direction M. The concave portions 215*a* to 215*a* and the fastening portions 215*a*1 to 215*a*3 are provided equally along the axial direction M in the support portion 2151.

Through holes 215*b*1, 215*b*2 and 215*b*3 through which the fastening members SC are inserted are provided at both of the end portions and the center portion of the other support portion 2152 in the axial direction M. The convex portions 215*b* to 215*b* and the through holes 215*b*1 to 215*b*3 are provided equally in the axial direction M in the other support portion 2152.

The holes 217*a* in the slide sheet 217 are provided at a plurality of points (eight points in this example) in the axial direction M. Through holes 217*b* to 217*d* through which the fastening members SC are inserted are provided at both of the end portions and the center portion of the slide sheet 217 in the axial direction M (see FIG. 9). The holes 217*a* to 217*a* and the through holes 217*b* to 217*d* are provided at both of the end portions of the slide sheet 217 in the circumferential direction W around the rotational axis 6. The holes 217*a* to 217*a* and the through holes 217*b* to 217*d* are equally provided along the axial direction M in the slide sheet 217. The fastening members SC to SC are fastened to the fastening portions 215*a*1 to 215*a*3 in a state of being inserted through the through holes 215*b*1 to 215*b*3 and the through holes 217*b* to 217*d*. Thus, the two support portions 2151 and 2152 can be fixed while the slide sheet 217 is sandwiched between the two support portions 2151 and 2152.

Note that, the concave portion 215*a* may be engaged in a state that the central fastening portion 215*a*3 is the concave portion 215*a* in the support portion 2151, the central through hole 215*b*3 is the convex portion 215*b* in the other support portion 2152, and the central through hole 217*d* is the hole 217*a* in the slide sheet 217, and the convex portion 215*b* is inserted into the hole 217*a*.

The nip forming member 212 and the support member 215 are fixed by the fastening member SC. Insertion portions 212*b* and 212*c* (notches or through holes, in this example, notches) (see FIGS. 8A and 8B) through which the fastening members SC are inserted are provided at both of the end portions of the nip forming member 212 in the axial direction M. Fastening portions 215*a*4 and 215*a*5 (female screw holes in this example) (see FIG. 8B) for screwing with the fastening members SC are provided at both of the end portions of the support portion 2151 in the axial direction M. The fastening members SC and SC are fastened to the fastening portions 215*a*4 and 215*a*5 in a state of being inserted through the insertion portions 212*b* and 212*c*. Thus, the support member 215 can support the nip forming member 212 while the nip forming member 212 is fixed.

In the present embodiment, one support portion 2151 and the other support portion 2152 of the two support portions 2151 and 2152 have first cohesion surfaces 215*c* and 215*d* (see FIG. 7) and second cohesion surfaces 215*e* and 215*f* (see FIGS. 7A and 7B). The first cohesion surfaces 215*c* and 215*d* are in close contact with each other via the slide sheet 217. The second cohesion surfaces 215*e* and 215*f* are in close contact with the nip forming member 212 via the slide sheet 217. The slide sheet 217 is fixed between the first cohesion surface 215*c* of the support portion 2151 and the first cohesion surface 215*d* of the other support portion 2152. Thus, the slide sheet 217 can be closely fixed between the first cohesion surface 215*c* of the support portion 2151 and the first cohesion surface 215*d* of the other support portion 2152. Accordingly, the slide sheet 217 can be reliably fixed by the two support portions 2151 and 2152 and the nip forming member 212.

In the present embodiment, the first cohesion surfaces 215*c* and 215*d* of the support portion 2151 and the other support portion 2152 extend in an intersecting direction R (in this example, an orthogonal direction) intersecting the second cohesion surfaces 215*e* and 215*f* of the support portion 2151 and the other support portion 2152. Thus, it is possible to increase the area in which the support portion 2151 and the other support portion 2152 are closely contacted with and fixed to the slide sheet 217, and the slide sheet 217 can be reliably fixed accordingly. In this example, the first cohesion surfaces 215*c* and 215*d* extend in the pressing direction of the pressure roller 220 against the nip forming member 212 with respect to the second cohesion surfaces 215*e* and 215*f*.

Here, the support member 215 may be formed in an I-shape in a cross-sectional view seen from the axial direction M by the two support portions (for example, two I-shaped support portions faces each other to form the I-shape). In this case, in order to reliably support the nip forming member 212, it is necessary to increase the size of the two I-shaped support portions in the short side direction S orthogonal to the axial direction M. As a result, it is not possible to secure a space on the upstream side and/or the downstream side in the conveying direction F of the recording medium P, which leads to an increase in the size of the heat fixer 210 and an increase in the size of the fixing device 200.

In this respect, in the present embodiment, the support member 215 is formed in a T-shape in a cross-sectional view seen from the axial direction M by the two support portions 2151 and 2152. In this way, it is possible to secure a space on the upstream side and/or the downstream side in the conveying direction F of the recording medium P, so that it is possible to realize the miniaturization of the heat fixer 210 and thus the miniaturization of the fixing device 200.

In the present embodiment, as to the support member 215, each of the two support portions 2151 and 2152 is the L-shaped support portion when viewed from the axial direction M. The support member 215 is formed in a T-shape by a straight portion 215*g* on one side of the L-shape of the support portion 2151 and a straight portion 215*h* on one side of the L-shape of the other support portion 2152 facing each other. In this way, the T-shaped support member 215 can be configured in such a manner that the space saving based on the L-shape can be realized while the slide sheet 217 is fixed between the two support portions 2151 and 2152.

More specifically, the support portion 2151 is a sheet metal member in which a plate-like member is bent in the intersecting direction R from the end portion on the side of the conveying direction F of the recording medium P. In this example, the thickness of each of the two support portions 2151 and 2152 is the same and is approximately 1.6 mm. The other support portion 2152 is a sheet metal member in which a plate-like member is bent in the intersecting direction R from the end portion on the side opposite to the conveying direction F of the recording medium P. As shown in FIGS. 10A and 10B, the front end portions and the rear end portions of the two support portions 2151 and 2152 are fixed to the front upper frame 231 and the rear upper frame 241 via a front support portion 231*e* and a rear support portion 241*e*, respectively. The two support portions 2151 and 2152 are provided with extension portions (2151*a* and 2151*b*) and (2152*a* and 2152*b*) extending outward from both of the end portions in the axial direction M. The front support portion 231*e* and the rear support portion 241*e* are provided with through holes 231*f* and 241*f* penetrating in the axial direction M, respectively. The two support portions 2151 and 2152 are fixed to the front support portion 231*e* and the rear support portion 241*e* in a state where the extension portions (2151*a* and 2151*b*) and (2152*a* and 2152*b*) are inserted into the through holes 231*f* and 241*f*.

In the present embodiment, the slide sheet 217 includes a first sheet portion 2171, a second sheet portion 2172, and a third sheet portion 2173. The first sheet portion 2171 covers the nip forming member 212 in the circumferential direction W around the rotational axis 6 of the fixing belt 211. The first sheet portion 2171 covers the entire circumference of the nip forming member 212 in the circumferential direction W. The second sheet portion 2172 is juncturally connected to the upstream end of the first sheet portion 2171 in the conveying direction F of the recording medium P in the circumferential direction W. The third sheet portion 2173 is juncturally connected to the downstream end of the first sheet portion 2171 in the conveying direction F of the recording medium P in the circumferential direction W. In the slide sheet 217, the second sheet portion 2172 and the third sheet portion 2173 are fixed between the two support portions 2151 and 2152. Thus, the first sheet portion 2171 covers the nip forming member 212 in the circumferential direction W around the rotational axis 6 of the fixing belt 211. Therefore, the slide sheet 217 can be held by the two support portions 2151 and 2152 and the nip forming member 212. Accordingly, the movement of the slide sheet 217 can be reliably regulated by the two support portions 2151 and 2152 and the nip forming member 212. Moreover, the second sheet portion 2172 is juncturally connected to the upstream end of the first sheet portion 2171 in the conveying direction F of the recording medium P in the circumferential direction W, and is fixed between the two support portions 2151 and 2152. Therefore, the slide sheet 217 can be reliably fixed between the two support portions 2151 and 2152 while the slide sheet 217 is held by the two support portions 2151 and 2152, and the nip forming member 212. Accordingly, it is possible to effectively prevent the slide sheet 217 from shifting due to the rotational movement of the fixing belt 211 caused by the rotational drive of the pressure roller 220. Further, the third sheet portion 2173 is juncturally connected to the downstream end of the first sheet portion 2171 in the conveying direction F of the recording medium P in the circumferential direction W, and is fixed together with the second sheet portion 2172 between the two support portions 2151 and 2152. Therefore, the slide sheet 217 can be more reliably fixed between the two support portions 2151 and 2152 while the slide sheet 217 is held by the two support portions 2151 and 2152, and the nip forming member 212. Accordingly, it is possible to prevent the slide sheet 217 more effectively from shifting due to the rotational movement of the fixing belt 211 caused by the rotational drive of the pressure roller 220.

Second Embodiment

Figure 11A:
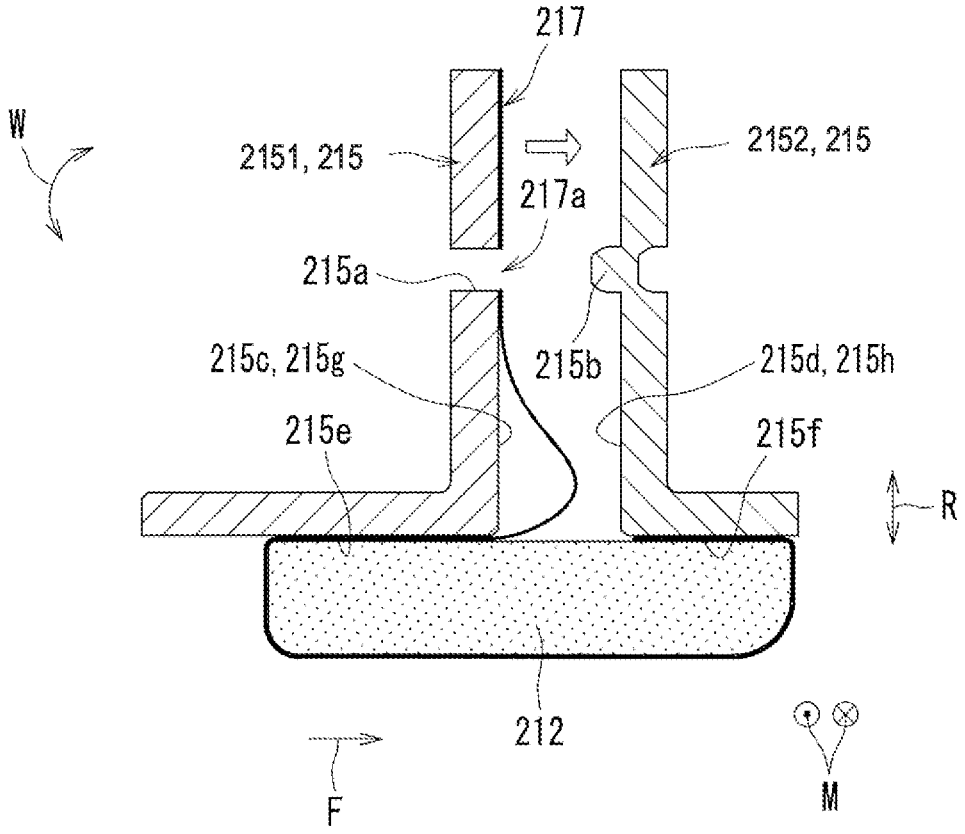
FIG. 11A is a cross-sectional view showing a state in which a slide sheet covers a nip forming member and is fixed to a support member in a fixing device according to a second embodiment.
Figure 11B:
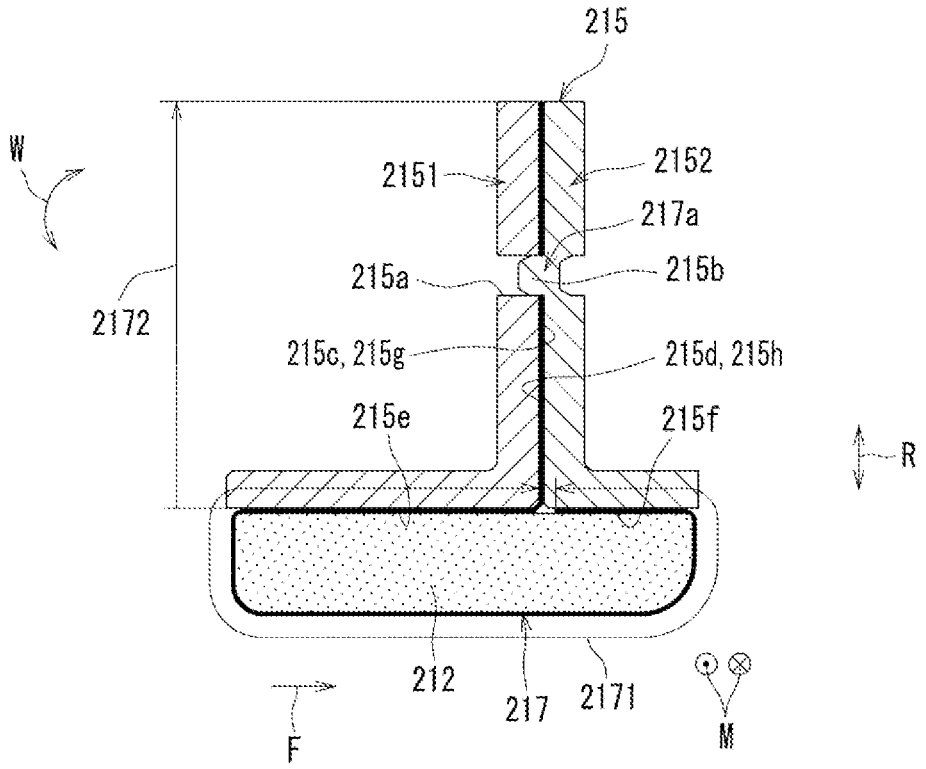
FIG. 11B is a cross-sectional view showing a state in which the slide sheet covering the nip forming member is fixed to the support member from the state shown in FIG. 11A.
Figure 12:
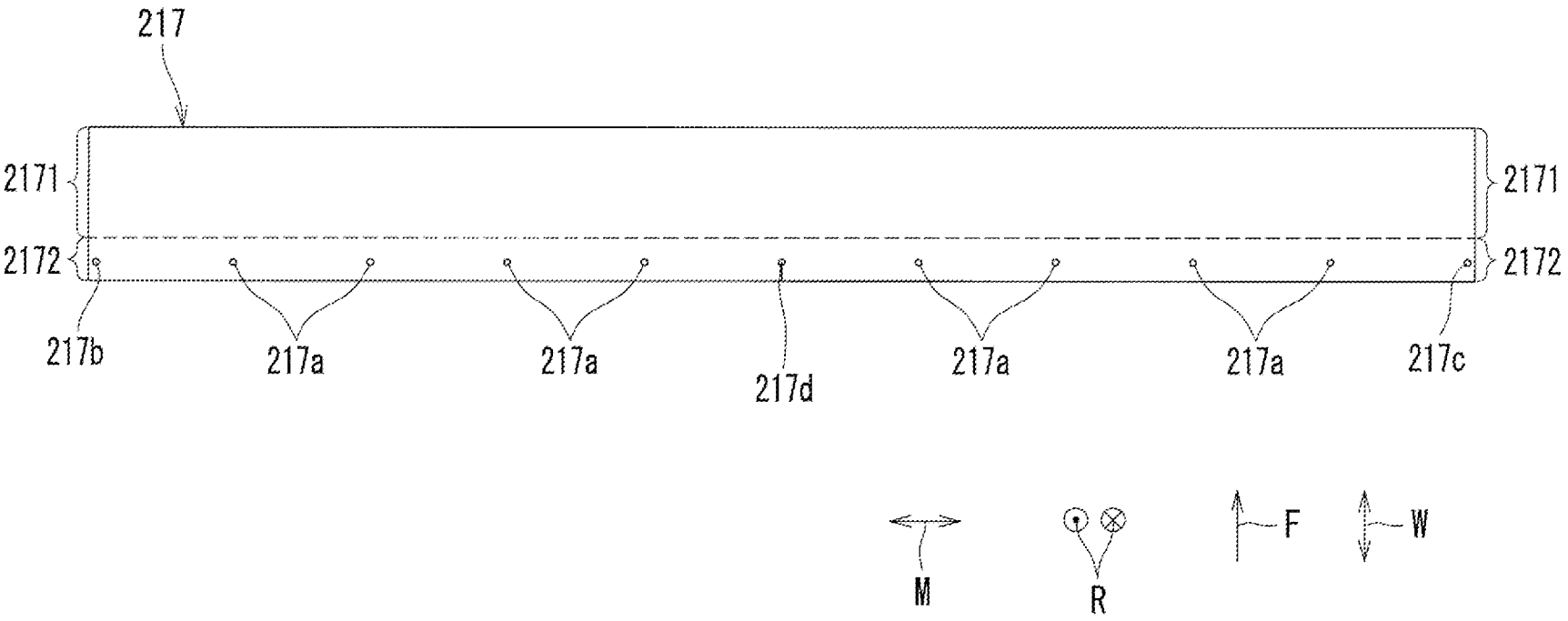
FIG. 12 is a developed view of the slide sheet in the fixing device according to the second embodiment.

FIG. 11A is a cross-sectional view showing a state in which the slide sheet 217 covers the nip forming member 212 and is fixed to the support member 215 in the fixing device 200 according to a second embodiment. FIG. 11B is a cross-sectional view showing a state in which the slide sheet 217 covering the nip forming member 212 is fixed to the support member 215 from the state shown in FIG. 11A. Further, FIG. 12 is a developed view of the slide sheet 217 in the fixing device 200 according to the second embodiment.

The slide sheet 217 in the fixing device 200 according to the second embodiment is the same as the slide sheet 217 in the fixing device 200 according to the first embodiment except that the slide sheet 217 does not have the third sheet portion 2173.

In the slide sheet 217, the third sheet portion 2173 on the downstream side of the first sheet portion 2171 in the conveying direction F of the recording medium P is less likely to be subjected to a load accompanying the rotational movement of the fixing belt 211 by the rotational drive of the pressure roller 220.

In this regard, the slide sheet 217 in the fixing device 200 according to the second embodiment is configured by the first sheet portion 2171 and the second sheet portion 2172. The first sheet portion 2171 covers the whole or substantially the whole circumference (in this example, substantially the whole circumference) of the nip forming member 212 in the circumferential direction W. In this way, the size of the slide sheet 217 in the circumferential direction W can be shortened, and the cost of the slide sheet 217 can be reduced accordingly.

Third Embodiment

Figure 13:
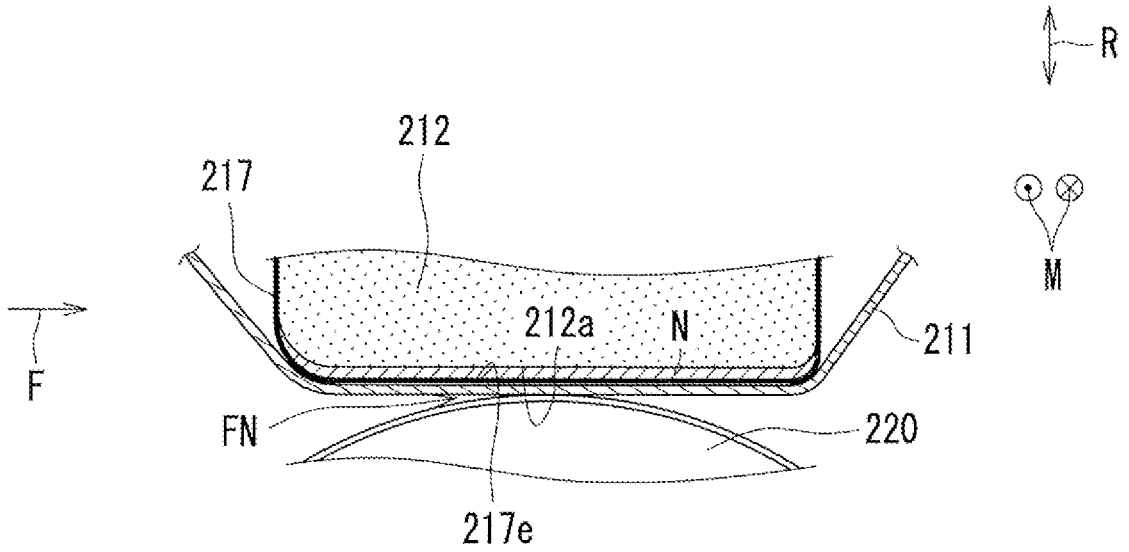
FIG. 13 is an enlarged cross-sectional view showing a contact portion between a slide sheet and a fixing belt in a fixing device according to a third embodiment.

FIG. 13 is an enlarged cross-sectional view showing a contact portion between the slide sheet 217 and the fixing belt 211 in the fixing device 200 according to a third embodiment.

When the fixing belt 211 is rotationally moved by the rotational drive of the pressure roller 220, a load is easily applied to the contact surfaces 217*e* and 212*a* between the portion of the slide sheet 217 which is in sliding contact with the fixing belt 211 and the nip forming member 212, and therefore the slide sheet 217 is easily shifted at the contact surfaces 217*e* and 212*a*.

In this regard, in the fixing device 200 according to the third embodiment, all or a part of the contact surfaces 217*e* and 212*a* between the portion of the slide sheet 217 which is in sliding contact with the fixing belt 211 and the nip forming member 212 in the fixing devices 200 according to the first and second embodiments are adhered to each other by an adhesive or an adhesive member (adhesive N in this example). In this way, even if the fixing belt 211 is rotationally moved along with the rotational drive of the pressure roller 220, and a load is applied to the contact surfaces 217*e* and 212*a* between the portion of the slide sheet 217 which is in sliding contact with the fixing belt 211 and the nip forming member 212, the slide sheet 217 can be prevented from shifting by the contact surfaces 217*e* and 212*a* adhered by the adhesive or the adhesive member (adhesive N in this example). The adhesive may be a heat-resistant adhesive. The adhesive member may be a heat-resistant adhesive sheet. Therefore, it is possible to prevent the slide sheet 217 more effectively from shifting due to the rotational movement of the fixing belt 211 caused by the rotational drive of the pressure roller 220.

Note that the slide sheet 217 may be adhered to the entire contact surface of the nip forming member 212, or alternatively or additionally, may be adhered between the two support portions 2151 and 2152. Further, the slide sheet 217 may be adhered between the slide sheets 217 and 217, which are provided between the two support portions 2151 and 2152.

Fourth Embodiment

Figure 14:
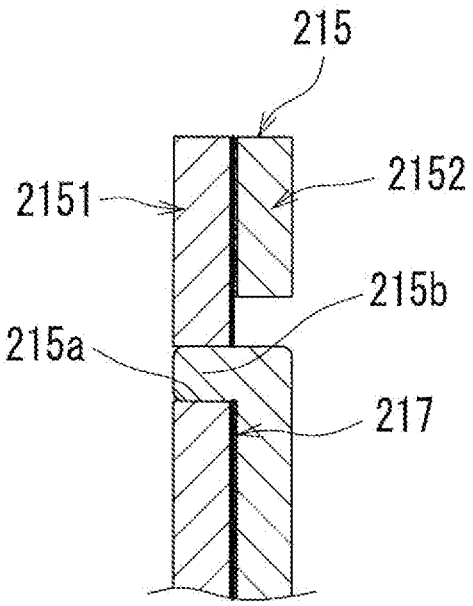
FIG. 14 is an enlarged cross-sectional view showing a concave portion of one support portion and a convex portion of the other support portion in a fixing device according to a fourth embodiment.

FIG. 14 is an enlarged cross-sectional view showing the concave portion 215*a* of the support portion 2151 and the convex portion 215*b* of the other support portion 2152 in the fixing device 200 according to a fourth embodiment.

In the fixing device 200 according to the fourth embodiment, the convex portion 215*b* of the other support portion 2152 is bent in the fixing devices 200 according to the first to third embodiments. This makes it possible to reliably form the convex portion 215*b* of the other support portion 2152.

Other Embodiments

In the fixing device 200 according to the first to fourth embodiments, the concave portion 215*a* is formed in the support portion 2151, and the convex portion 215*b* is formed in the other support portion 2152. However, a convex portion may be formed on the support portion 2151, and a concave portion may be formed on the other support portion 2152.

The present invention is not limited to the embodiments described above, but may be implemented in various other forms. Therefore, such embodiments are merely examples in all respects and should not be construed as limiting. The scope of the present invention is indicated by the claims, and is not limited to the foregoing description. Further, all modifications and variations belonging to the equivalent scope of the claims are within the scope of the present invention.

What is claimed is:

1. A fixing device comprising:

an endless fixing belt capable of rotational movement;

a pressure roller that presses from an outside of the fixing belt;

a nip forming member that is arranged on an inner circumference surface side of the fixing belt and forms a fixing nip region between the fixing belt and the pressure roller;

a support member that supports the nip forming member from an opposite side to the fixing nip region; and a slide sheet provided between the fixing belt and the nip forming member, wherein the support member comprises two support portions, and the slide sheet is fixed between the two support portions, and wherein a concave portion is provided in one of the two support portions, a convex portion engaged with the concave portion is provided in the other of the two support portions, and the slide sheet is fixed by the convex portion engaged with the concave portion.

2. The fixing device according to claim 1, wherein the slide sheet is fixed in a state of being sandwiched between the two support portions.

3. The fixing device according to claim 1, wherein the concave portion is a hole through which the convex portion is inserted.

4. The fixing device according to claim 1, wherein the slide sheet is provided with a hole through which the convex portion is inserted.

5. A fixing device comprising:

an endless fixing belt capable of rotational movement;

a pressure roller that presses from an outside of the fixing belt;

a nip forming member that is arranged on an inner circumference surface side of the fixing belt and forms a fixing nip region between the fixing belt and the pressure roller;

a support member that supports the nip forming member from an opposite side to the fixing nip region; and a slide sheet provided between the fixing belt and the nip forming member, where:

the support member comprises two support portions, and the slide sheet is fixed between the two support portions, each of the two support portions comprising a first cohesion surface and a second cohesion surface, the two first cohesion surfaces being in close contact with each other via the slide sheet and the two second cohesion surfaces being in close contact with the nip forming member via the slide sheet, the slide sheet is fixed between the first cohesion surface in the one support portion and the first cohesion surface in the other support portion, and the first cohesion surfaces of the one support portion and the other support portion extend in an intersecting direction intersecting with the second cohesion surfaces of the one support portion and the other support portion.

6. A fixing device comprising:

an endless fixing belt capable of rotational movement;

a pressure roller that presses from an outside of the fixing belt;

a nip forming member that is arranged on an inner circumference surface side of the fixing belt and forms a fixing nip region between the fixing belt and the pressure roller;

a support member that supports the nip forming member from an opposite side to the fixing nip region; and a slide sheet provided between the fixing belt and the nip forming member, where:

the support member comprises two support portions, and the slide sheet is fixed between the two support portions, each of the two support portions comprising a first cohesion surface and a second cohesion surface, the two first cohesion surfaces being in close contact with each other via the slide sheet, and the two second cohesion surfaces being in close contact with the nip forming member via the slide sheet, the slide sheet is fixed between the first cohesion surface in the one support portion and the first cohesion surface in the other support portion, and the support member is formed in a T-shape in a cross-sectional view by the two support portions.

7. A fixing device comprising:

an endless fixing belt capable of rotational movement;

a pressure roller that presses from an outside of the fixing belt;

a nip forming member that is arranged on an inner circumference surface side of the fixing belt and forms a fixing nip region between the fixing belt and the pressure roller;

a support member that supports the nip forming member from an opposite side to the fixing nip region; and a slide sheet provided between the fixing belt and the nip forming member, where:

the support member comprises two support portions, and the slide sheet is fixed between the two support portions, each of the two support portions comprising a first cohesion surface and a second cohesion surface, the two first cohesion surfaces being in close contact with each other via the slide sheet, and the two second cohesion surfaces being in close contact with the nip forming member via the slide sheet, the slide sheet is fixed between the first cohesion surface in the one support portion and the first cohesion surface in the other support portion, and each of the two support portions is an L-shaped support portion in a cross-sectional view, and a straight portion on one side of the L-shape of the one support portion and a straight portion on one side of the L-shape of the other support portion face each other, so that the support member is formed in a T-shape.

8. The fixing device according to claim 1, wherein the slide sheet comprises:

a first sheet portion that covers the nip forming member in a circumferential direction around a rotational axis of the fixing belt;

a second sheet portion juncturally connected to an upstream end of the first sheet portion in the circumferential direction in a conveying direction of a recording medium; and a third sheet portion juncturally connected to a downstream end of the first sheet portion in the circumferential direction in the conveying direction of the recording medium, wherein the second sheet portion and the third sheet portion are fixed between the two support portions.

9. The fixing device according to claim 1, wherein the slide sheet comprises:

a first sheet portion that covers the nip forming member in a circumferential direction around a rotational axis of the fixing belt; and a second sheet portion juncturally connected to an upstream end of the first sheet in the circumferential direction in a conveying direction of a recording medium, wherein the second sheet portion is fixed between the two support portions.

10. An image forming device comprising the fixing device according to claim 1.

* * * * *